United States Patent [19]

Matsushita

[11] Patent Number: 4,607,985

[45] Date of Patent: Aug. 26, 1986

[54] BLOCK CONSTRUCTION FOR PREVENTING OUTFLOW OF BALLASTS

[75] Inventor: Takenobu Matsushita, Tokyo, Japan

[73] Assignees: Taizo Nozawa, Tokyo; Katsumasa Machii, Hiroshima, both of Japan; part interest to each

[21] Appl. No.: 733,412

[22] Filed: May 13, 1985

Related U.S. Application Data

[63] Continuation of Ser. No. 418,383, Sep. 15, 1982, abandoned.

[51] Int. Cl.[4] ..... E02D 29/02

[52] U.S. Cl. ..... 405/284; 405/258; 52/609

[58] Field of Search ..... 405/284–287, 405/272, 273; 52/609–611

[56] References Cited

U.S. PATENT DOCUMENTS

| | | | |
|---|---|---|---|
| 1,349,166 | 8/1920 | Paff | 405/286 |
| 1,778,574 | 10/1930 | Thornley | 405/286 |
| 2,388,624 | 11/1945 | Tashjian | 405/287 |
| 2,420,228 | 5/1947 | Condon | 405/286 |
| 3,282,056 | 11/1966 | Fisher | 405/286 |

FOREIGN PATENT DOCUMENTS

| | | | |
|---|---|---|---|
| 2268116 | 11/1975 | France | 405/284 |
| 38-24409 | 9/1963 | Japan | 405/284 |
| 55-20830 | 5/1980 | Japan . | |
| 101963 | 11/1923 | Switzerland | 405/286 |

OTHER PUBLICATIONS

"Performance Tests and Design of Ballast-Retaining Blocks", RailWay magazine, vol. 30, Aug. 10, 1982.

*Primary Examiner*—Dennis L. Taylor

*Attorney, Agent, or Firm*—Wenderoth, Lind & Ponack

[57] ABSTRACT

A block construction for preventing the outflow of ballast along a railway which includes a slab body, a ballast-retaining wall extending upward form the slab body at a location spaced from the front and rear edges of the slab body, for retaining ballast on the laterally rearward side thereof, and a pair of spaced apart legs extending downward from the rear edge of the slab for being buried in holes in a roadbed along the railway for firmly fixing the slab relative to the ground. The slab has an upper surface forward of the retaining wall of sufficient lateral extent to provide a longitudinally extending walkway for use by railway construction and maintenance personnel.

4 Claims, 2 Drawing Figures

BLOCK CONSTRUCTION FOR PREVENTING OUTFLOW OF BALLASTS

This application is a continuation of now abandoned application Ser. No. 416,383, filed Sept. 15, 1982.

FIELD OF THE INVENTION

The present invention relates to a block construction as a structure for a raceway and particularly to a block construction for preventing outflow of ballast laid along the lateral rim of a ballast bed and for serving as a walk path for construction workers.

BACKGROUND OF THE INVENTION

A concrete slab proposed formerly by the present applicant as a block construction for preventing outflow of ballast of the type of the present invention was registered as Japanese Utility Model Registration No. 1,367,094. In this prior structure the bottom surface of a concrete slab is moulded with a projection of inverse pyramid or inverse cone shape to be buried in the ground. The strength of such a structure, however, may be insufficient in the event of an earthquake.

OBJECT OF INVENTION

The object of the present invention is to provide a block construction for preventing outflow ballast laid tightly on a railway bed, thereby reliably preventing outflow of ballast at the time of an earthquake.

SUMMARY OF THE INVENTION

The present invention is a block construction for preventing the outflow of ballast in the event of a major trama such as an earthquake. A ballast-retaining wall is erected in the middle of the top surface of a slab body for retaining ballast along a railway, wherein the top surface of the slab body on one lateral side of retaining wall serves as a walk path and the top surface of the slab body on the other lateral side of the retaining wall serves as a ballast-piling surface, and legs project downward from the end of the piling surface into the roadbed adjacent the ballast.

BRIEF DESCRIPTION OF DRAWINGS

The appended drawings illustrate an exemplary embodiment of the block construction for preventing outflow ballast according to the present invention.

DETAILED DESCRIPTION OF THE PREFERRED EMBODIMENT

Figure 1:
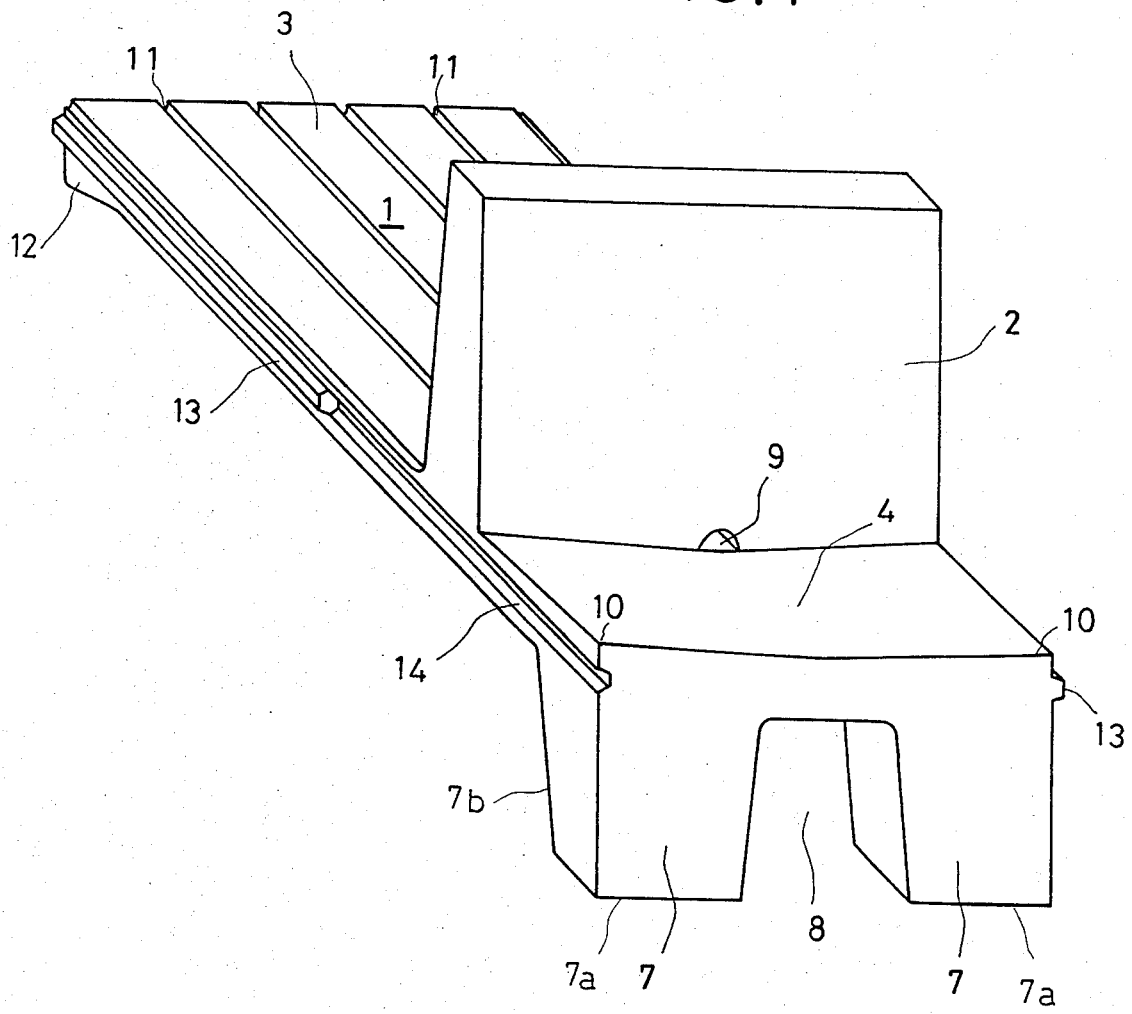
FIG. 1 is perspective view of a block construction according to the invention.

With reference to the drawings, the preferred embodiment of the block construction of the present invention is described as follows:

In the block construction for preventing the outflow of ballast according to the invention a ballast-retaining wall 2 is arranged upright in the middle of the top surface of a slab body 1, wherein the top surface of the slab body on one lateral side of said retaining wall 2 serves as a walk path 3, whereas the top surface of the slab body on the other lateral side of said retaining wall 2 serves as a ballast-piling surface, and on the other hand, tapered legs 7 having downwardly tapered rear, front and side surfaces **7*b*, the front surfaces sloping rearwardly, projected downwards from the end of the bottom surface of slab body 1 on the side of ballast-piling surface 4 are buried in a hole 6** dug in a roadbed.

The legs 7 project from the rearmost end of the bottom surface of the slab in a tapered manner to flat bottom surfaces **7*a*, with a trapezoidal gap 8 therebetween. As a number of the blocks for preventing outflow of ballast according to the present invention are connected in series side-by-side, if the legs 7 were not separated by gaps as illustrated in FIG. 1, the holes 6 to be dug would form a linear continuous groove so that the stable roadbed would be dug out a great deal. However, by providing the gaps between the legs 7 only the railway ground portion for inserting legs 7 need be dug to form respective holes 6 or, in other words, the holes 6** may be dug at a constant interval so as to lessen the weakness to the roadbed.

In addition, retaining wall 2 is provided with a front-to-rear extending drain hole 9 at the base thereof and the ballast-piling surface 4 is sloped downwardly from the external (rear) edge 10 of the ballast-piling surface to the drain hole 9 so that the water flowing on the ballast-piling surface may be reliably guided to said hole 9 for discharge across walk path 3.

Also, the walk path 3 is provided with discharging groove 11 for allowing the water from the drain hole 9 to flow forward and off of the slab body.

Furthermore, spikes 12 are provided respectively at both ends on each side of walk path 3 on the bottom plane of slab body 1.

Numerals 13 and 14 in the drawings respectively denote a male part and a female part formed staggered alternatively on opposite sides of slab body 1 so as to fit with one of the complements on adjacent slab bodies 1.

A working process for laying on an existent roadbed the blocks for preventing an outflow of ballast according to the present invention is described as follows: The process comprises the steps of cutting the edges of the ballast bed, excavating the ground portion 18 from a cut part 16 to the sloped roadbed face 17, digging the roadbed 5 and simultaneously forming the holes 6 for burying the legs 7, laying sand and coarse chips 19 etc. on the excavated roadbed portion 18, laying slab body 1 on said spread sand and coarse chips etc. and simultaneously burying legs 7 in holes 6, and piling ballast **15*a* on the ballast-piling surface 4 of slab body 1**.

Figure 2:
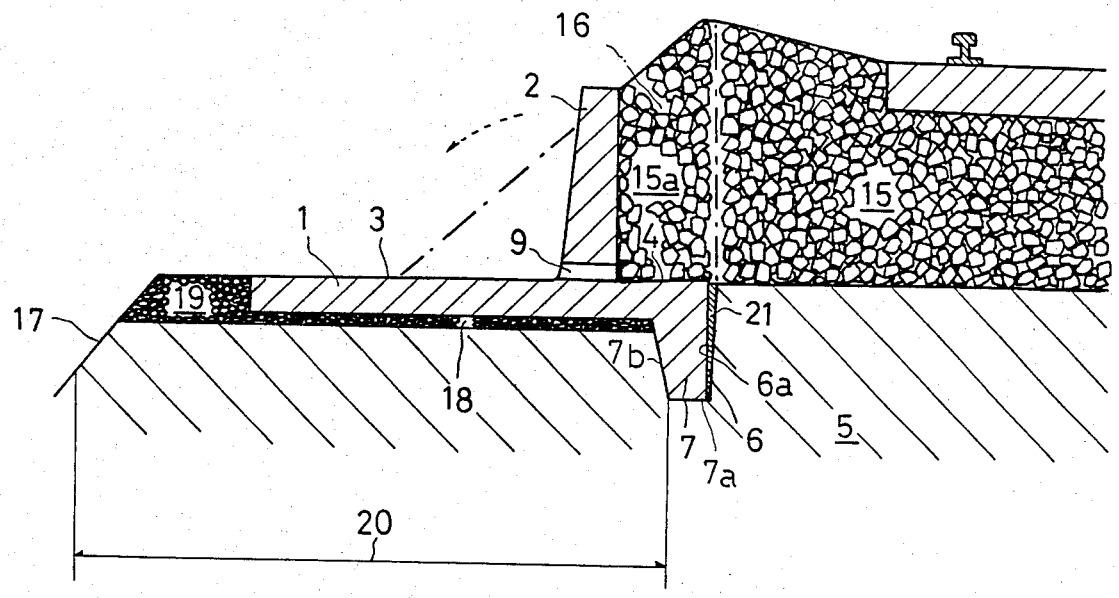
FIG. 2 is a cross-sectional view of the block construction of the invention in use.

As is shown in FIG. 2, in the block construction for preventing outflow ballast which is composed as above described, the ballast is piled on the ballast-piling surface 4 and is supported by the retaining wall 2, whereas the legs 7 are arranged along the side edge of the ballast-bed 15 and buried in the hole 6 formed in the roadbed 5.

Regarding the thus laid blocks according to the present invention, because the ballast **15*a* is piled on the ballast-piling surface 4 and the legs 7 are buried in the holes 6 in roadbed 5, the displacement of the slab body 1 under application of the force upon retaining wall 2 by the ballast 15*a* is prevented. Particularly, because the legs 7 are projected from the edge on the side of ballast-piling surface 4 in the bottom plane of slab body 1, the distance 20 from legs 7 to the sloped roadbed face 17 is long, and therefore the force required for the displacement of leg 7 toward the sloped roadbed face 17 is sufficiently supported by the roadbed 5 of said large distance 20**.

If the legs were projected from the middle of the bottom plane of slab body 1, it would be difficult to fill the gap between legs and the internal walls of the holes into which they are inserted. However because the blocks of the present invention having legs 7 projected from the edge of the bottom plane of slab body 1, the gap 21 between each leg 7 and the internal wall 6*a* of the hole 6 into which it is inserted can be easily filled.

Because the block construction for preventing the outflow of ballast according to the present invention can be laid while being fixed tightly to the roadbed 5, the collapse of the ballast bed 15 may be sufficiently guarded against at the time of a trama such as an earthquake. The block construction of the invention is more earthquake-proof than conventional blocks of the present type.

What is claimed is:

1. A block construction for preventing the outflow of ballast, comprising:

a generally horizontally extending slab body having a front edge and a rear edge at respective laterally opposite ends thereof;

means, including a ballast-retaining wall extending longitudinally and vertically upward from said slab body at a location spaced from said front and rear edges, for retaining ballast on the laterally rearward side thereof; and means, including a pair of spaced apart legs having horizontal flat bottom surfaces, extending downward from said rear edge of said slab for being buried in holes in a roadbed, for firmly fixing said slab relative to the ground, said ballast-retaining wall being laterally spaced from said legs and being located closer to said rear edge than to said front edge;

said slab having a first upper surface forward of said ballast-retaining wall extending from said front edge to said ballast-retaining wall of sufficient lateral extend to provide a longitudinally extending walkway, and a second upper surface rearward of said ballast-retaining wall for supporting ballast thereon piled against said ballast-retaining wall forward of said legs;

the forwardly facing surfaces of said legs sloping rearwardly and downwardly in a single plane.

2. A block construction as in claim 1, wherein said legs taper downwardly so as to leave a space therebetween having a trapezoidally shaped cross section in a vertically and longitudinally extending plane.

3. A block construction as in claim 1, wherein said ballast retaining wall has a laterally extending drain hole at the base thereof, said second upper surface being inclined downwardly thereover toward said drain hole such that any water collecting on said second upper surface flows toward and through said drain hole onto said first upper surface.

4. A block construction as in claim 1, wherein said ballast retaining wall has a laterally extending drain hole at the base thereof, said second upper surface being inclined downwardly thereover toward said drain hole such that any water collecting on said second upper surface flows toward and through said drain hole onto said first upper surface.

* * * * *